US005693287A

United States Patent [19]

Van Kuijeren et al.

[11] Patent Number: 5,693,287

[45] Date of Patent: Dec. 2, 1997

[54] APPARATUS AND METHOD FOR THE MANUFACTURE OF DR STEEL STRIP

[75] Inventors: Herman C. P. Van Kuijeren, Heerhugowaard; Jacobus W. M. van der Lee, Hoorn; Klaas Vink, Hoofddorp, all of Netherlands

[73] Assignee: Hoogovens Staal BV, Ijmuiden, Netherlands

[21] Appl. No.: 428,622

[22] Filed: Apr. 25, 1995

[30] Foreign Application Priority Data

Apr. 27, 1994 [NL] Netherlands ..... 9400674

[51] Int. Cl.[6] ..... C21D 9/54

[52] U.S. Cl. ..... 266/103

[58] Field of Search ..... 266/102, 103, 266/87, 78, 96, 99; 72/201

[56] References Cited

U.S. PATENT DOCUMENTS

| | | | |
|---|---|---|---|
| 2,139,483 | 12/1938 | Badlam | 266/103 |
| 2,658,741 | 11/1953 | Schmidt et al. | 266/103 |
| 3,095,361 | 6/1963 | Stone | 204/28 |
| 3,580,033 | 5/1971 | Gay | 72/201 |
| 4,379,547 | 4/1983 | Shimbashi et al. | 266/103 |

FOREIGN PATENT DOCUMENTS

| | | |
|---|---|---|
| 0046423 | 2/1982 | European Pat. Off. . |
| 0436762 | 7/1991 | European Pat. Off. . |
| 1563057 | 4/1969 | France . |

OTHER PUBLICATIONS

Steel in the USSR, 19, No. 6, Jun. 1989, pp. 256–258 "Development and Introduction of Efficient Schedules for Rolling . . . ".

Database WPI, AN 79–41353B, Apr. 1979, JP–A–54–49958.

*Primary Examiner*—Scott Kastler

*Attorney, Agent, or Firm*—Watson Cole Stevens Davis, P.L.L.C.

[57] ABSTRACT

Apparatus and method for manufacture of DR (Double Reduced) steel strip in which a continuous annealing furnace is arranged for annealing of cold-reduced steel strip passing continuously through said furnace, and a rolling mill for cold-rolling of steel strip is arranged to receive in-line the output of annealed steel strip from said furnace. The mill has at least one roll stand having a pair of work rolls of which only one is driven externally. Rolling fluid, preferably free of mineral oil, is supplied to the strip being rolled in the rolling mill, and is removed from the strip prior to entry of the strip to downstream tension-applying means.

12 Claims, 1 Drawing Sheet

APPARATUS AND METHOD FOR THE MANUFACTURE OF DR STEEL STRIP

BACKGROUND OF THE INVENTION

1. Field of the Invention

The invention relates to an apparatus and to a method for the manufacture of DR (Double Reduced) steel strip.

2. Description of the Invention

DR steel strip is a packaging steel in strip form with a high yield strength or hardness, such as is described in European standard EN 10203, table 3. Reference is also made to "Tin Mill Products" of the American Iron and Steel Institute, and Japanese standard JIS G3303.

EN 10203 defines the following grades:

| Grade | 0.2% Proof Stress [N/mm$^2$] | Hardness HR 30 Tm [N/mm$^2$] | Equivalent US and JP |
|---|---|---|---|
| DR 550 | 550 +/− 70 | 73 +/− 3 | DR-8 |
| DR 620 | 620 +/− 70 | 76 +/− 3 | DR-9 |
| DR 660 | 660 +/− 70 | 77 +/− 3 | DR-9M |

The present invention is thus concerned with the manufacture of such a DR strip, particularly one having a 0.2% proof stress of at least 550 N/mm$^2$ or a hardness of at least 73 N/mm$^2$.

It is known to manufacture DR strip steel in a double cold reducing mill in which cold-reduced and continuously annealed steel is reduced comparatively greatly in thickness. Depending on the intended yield strength, the reduction is up to 50%. DR rolling takes place wet; in other words a rolling fluid is applied as lubricant in the form of an aqueous emulsion of a mineral oil. In practice the continuous annealing step and the subsequent DR rolling step are two separate operations. See "Steel in the USSR", London, 19 (1989) June, No. 6, pages 256–258, U.S. Pat. No. 3095361 and EP-A-46423.

It can be mentioned that, for grades of packaging steel with a lower yield strength than DR steel strip, cold-reduced and annealed steel is temper rolled in separate operations. The purpose of this is to deform the steel beyond the yield strength in order to prevent so-called Lüders lines in a further deformation, and in certain cases to achieve an aesthetic effect on the surface. In such temper rolling, small reductions of from 1 to at most a few percent are applied. Temper rolling takes place dry, in other words without application of a rolling fluid.

The step of continuous annealing means that the strip is passed in unwound form continuously through an annealing furnace which creates the desired temperature profile in the strip. It is therefore important that the strip speed in the furnace is constant. This is in contrast to coil annealing, in which a whole coil is subjected to heating over a long period.

In the manufacture of DR steel strip, it has not previously been thought possible to combine continuous annealing and the subsequent cold-reduction step in a single in-line operation.

SUMMARY OF THE INVENTION

An object of the invention is to provide an apparatus and a method, whereby DR steel strip can be manufactured in an in-line operation combining continuous annealing and the subsequent cold-reduction.

In accordance with the invention in one aspect, there is provided apparatus for manufacture of DR steel strip, having (i) a continuous annealing furnace adapted for annealing of cold-reduced steel strip passing continuously through said furnace, (ii) a rolling mill for cold-rolling of steel strip arranged to receive in-line the output of annealed steel strip from said furnace and having at least one roll stand having a pair of work rolls of which only one is driven externally, (iii) means for applying tension to said strip being rolled in said rolling mill, including first tension applying means downstream of said rolling mill and second tension-applying means upstream thereof, (iv) means for supplying rolling fluid to said strip being rolled in said rolling mill, and (v) means for removing said rolling fluid from said strip prior to entry of said strip to said first tension-applying means.

This combination of measures makes it possible to manufacture DR steel strip from cold-reduced strip in one operation. The advantage of this is a considerable saving in cost because intermediate storing and intermediate transport between the two operations are obviated, while quality can improve in part because transport damage is avoided and production output increases.

By the statement that the annealed strip is received in-line by the rolling mill is meant that the strip is passing simultaneously through both the annealing furnace and the rolling mill, apart possibly from speed adjustments at the ends of a length of strip (for which purpose accumulators such as adjustable loopers may be employed).

The feature that the work rolls of the roll stand of the rolling mill are externally driven on one side only means that the other non-driven work roll is rotated by virtue of its contact with the strip. Preferably the driven work roll is driven via a support or back-up roll or rolls. This one-side driving of the roll stand allow the work rolls to be rapidly replaced, when necessary, since space is available in the mill for removing the used work rolls and inserting the fresh work rolls in the same direction, i.e. the used rolls are withdrawn towards one side of the roll stand and the fresh rolls are inserted from the opposite side of the roll stand. By virtue of this rapid roll change, disturbance of the continuous annealing operation can be eliminated or minimized, e.g. using an accumulator.

The feature that the rolling fluid is removed, e.g. by drying, prior to entry of the strip into the downstream tension applying means, is to avoid slipping of the strip in the tension applying means.

The rolling mill preferably has at least two roll stands. This has the advantage that the reduction can be given essentially in the first roll stand and the required surface finish can be applied essentially in the second roll stand.

The or each roll stand of the rolling mill is preferably a two-stand, six-high rolling mill. This enables larger reductions to be given.

The roughness of the work rolls of the first (upstream) roll stand is preferably less than 0.04 μm Ra, and these work rolls are more preferably polished and/or chrome-plated. Surprisingly it has been found that a large reduction in the first stand is facilitated if the work rolls in the first roll stand are very smooth, that is to say that they have a very low Ra roughness value.

Preferably the first tension applying means comprises a plurality of bridle roll pairs. The means for applying tension to the strip in the rolling mill may comprise also second tension applying means in the form of a plurality of bridle roll pairs upstream of the rolling mill.

Each of the first and second tension applying means may have three bridle roll pairs, and/or each of the first and second tension applying means may have at least one bridle roll pair with a roll diameter of at least 750 mm. In a rolling mill with work rolls driven on one side only, this means an additionally improved tensile stress in the strip during rolling, consequently permitting a big reduction in thickness in the rolling mill.

Preferably the means for removing the rolling fluid from the strip consists of a drying apparatus. Water in the rolling fluid can be removed efficiently and completely.

It has been found that, as a result of the large reductions occurring in the manufacture of DR strip steel in accordance with the invention, deviations can occur in the intended exit thickness of the DR strip steel. Consequently it is preferable to place a thickness gauge on the exit side of the rolling mill for measuring the thickness of the strip after rolling. Based on the measurement of the exit thickness of the DR strip steel, the reduction, and consequently the exit thickness can be adjusted manually or automatically within the range applicable for the relative DR grade for the yield strength or the hardness.

Preferably a thickness gauge is placed before the rolling mill for measuring the thickness of the strip before rolling. This allows the intended thickness of the DR strip steel to be achieved even better by compensating for any deviations of the entry thickness as measured by the thickness gauge within the permissible range for the yield strength or the hardness for the desired DR grade.

In another aspect the invention consists in a method for the manufacture of DR steel strip from cold-reduced steel strip, comprising the steps, performed in-line, of (i) continuous annealing of the cold-reduced steel strip in a continuous annealing furnace while applying a first tension to the strip, ii) passing the annealed steel strip from step (i) continuously to a rolling mill for cold-rolling of steel strip, as the strip emerges from the continuous annealing furnace, (iii) rolling the annealed steel strip from step (i) in said rolling mill, while applying a second tension to the strip in the rolling mill greater than said first tension by means of first tension-applying means downstream of the rolling mill and second tension-applying means upstream thereof, (iv) lubricating the strip during said rolling using a rolling fluid substantially free of mineral oil, (v) removing said rolling fluid from the strip after said rolling and prior to the entry of the strip to said first tension-applying means downstream of said rolling mill.

Preferably the second tension mentioned is at least 20 kN per meter of strip width, to provide suitable stable rolling. The first tension mentioned can be low, i.e. sufficient to maintain the transport of the strip in the annealing furnace, while avoiding any stretching of the soft annealed material, as is conventional.

Preferably the thickness reduction effected in the rolling mill is at least 15%, and is selected to provide the desired final properties of the strip.

Preferably, removal of the rolling fluid comprises drying the strip. These measures make it possible to manufacture DR steel strip in-line.

The rolling fluid is preferably a water washable fluid and more preferably an essentially mineral oil-free emulsion of oil-in-water type, preferably using at least one synthetic ester in the dispersed (internal) phase. This means that cleaning of the rolling mill other than rinsing with water followed by drying becomes superfluous. Therefore switching from DR to dry temper rolling of other grades of packaging steel takes a very short time. By contrast where mineral oil-containing emulsions have been used as rolling fluids in DR rolling, it has taken a long time, e.g. 8 hours, to clean the mill which becomes very dirty. This is impractical for such high-cost apparatus operating continuously, and has made it impossible to combine a continuous annealing furnace in-line with the rolling mill, because the capacity of the furnace is greater than required for DR strip production only. Therefore the furnace has been kept separate from the mill, to enable its capacity to be fully used in the production of various products. The invention allows these problems to be overcome.

During operation, preferably 50% by number of the drops (internal phase globules) in the emulsion are larger than 1 μm. Trials discussed later have shown that these large drops improve rolling results. Following preparation of the emulsion, the drops may become smaller over time and/or during operation. The emulsion may therefore be replaced when the drops as defined above become smaller than 1 μm.

Preferably removal of the rolling fluid comprises drying of the strip. Above all, this removes the water from the emulsion. Residues of the rolling fluid can have a preserving effect on the DR steel strip. When DR steel strip is to be further coated, for example tinned or chrome-plated, then those residues may be removed easily prior to coating in a cleaning section of a coating line. Residues of 10 to 15 $mg/m^2$ are acceptable.

The invention may further include the step of changing work rolls in the rolling mill by extracting used work rolls from the mill by moving them towards a first side of the mill and inserting replacement work rolls by moving them into the mill from a second side of the mill opposite to said first side. This step of changing work rolls may be performed without interruption of the continuous annealing of the strip in said continuous annealing furnace.

Preferably, DR steel strip manufactured by the method in accordance with the invention has a thickness of 0.15 mm or less. In this manner an excellent grade of hard, ultra-thin packaging steel can be manufactured that is suitable for all conventional further treatments, such as, for example tinning, chrome-plating or laminating with plastics material.

The steel used in the present invention is not limited except by the requirement that it is suitable to form the desired high temper product and may be a material conventionally used for DR products. Low carbon steels of C content 0.03 to 0.1 wt % are preferred.

BRIEF DESCRIPTION OF THE DRAWINGS

Embodiments of the invention will now be described by way of non-limitation example with reference to the accompanying drawings, in which.

DESCRIPTION OF THE PREFERRED EMBODIMENTS

EXAMPLE

Figure 1:
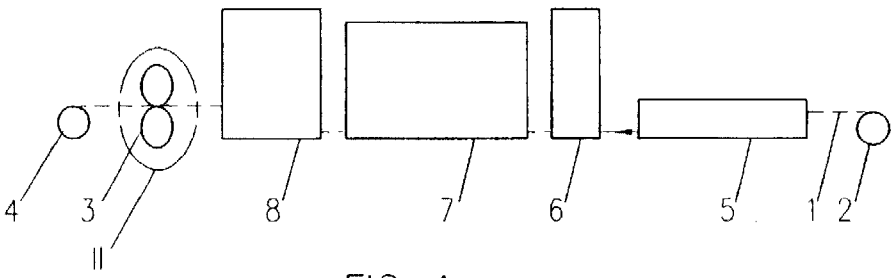
FIG. 1 is a diagram of apparatus embodying the invention.
Figure 2:
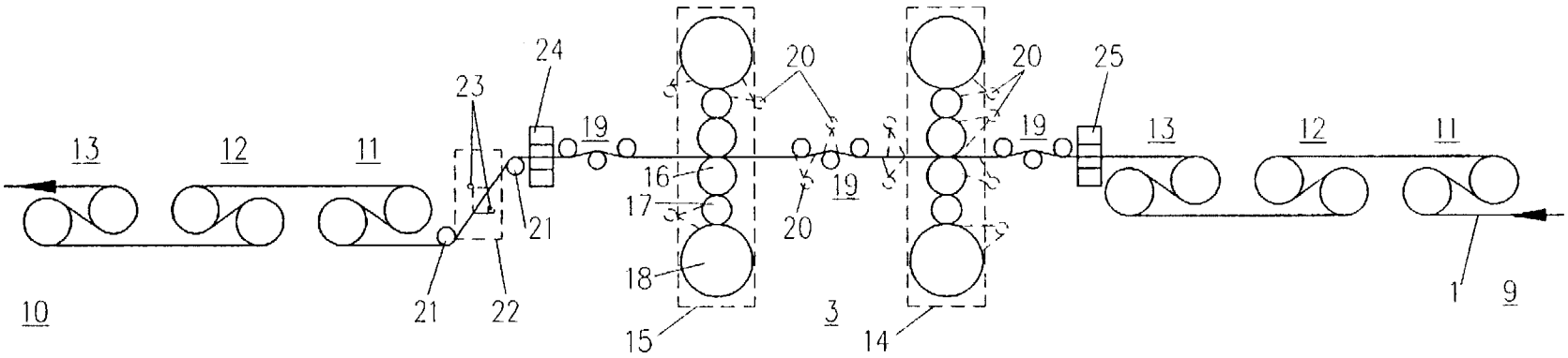
FIG. 2 is a diagrammatic view of the rolling mill 3 of the apparatus of FIG. 1.

A number of trials were carried out using an apparatus as shown in FIG. 1 and FIG. 2, described below. The conditions for those trials are given in the Table 1. Trials 4 to 8 are within the scope of the invention. The test material was cold-reduced low carbon steel strip measuring 900 mm (width)×0.19 mm (thickness). The steel used fulfilled the requirements:

C 0.06–0.1% by weight,

Mn 0.36–0.44% by weight,

N 55–90 ppm, remainder Fe and conventional trace elements. This steel was treated in a conventional manner to recrystallizing annealing at 600° C. in the continuous annealing furnace 7. By this the effects of the previous cold-reduction are substantially removed. The speed was 200 m/min at entry to the annealing furnace 7.

In trial no. 1 (see Table) the rolling in the mill 3 was dry, i.e. no rolling fluid was applied. A reduction of up to 2% was possible and grades of up to T67 temper were manufactured.

In trials 2, 3 and 4, the rolling in the mill 3 was wet, using as rolling fluid a mineral oil-free emulsion A of a synthetic ester in water. The synthetic ester lubricant was Sphinx RL 330 of Sphinx Chemical GmbH of Reiden, Switzerland. The synthetic ester was in an amount of 2% by weight in water.

In trial 2 no defined reduction and final thickness was obtained. This was caused by slipping of the wet strip. Next the strip was dried after leaving stand 15 of the temper-rolling mill. This essentially removed the water. Using this procedure in trial 3 produced a reduction of 15% and temper grade of T65 to T67 yet not DR. In the above trials ground work rolls were used with a normal roughness of 0.4 to 1.7 μm Ra.

Then in trial 4 polished work rolls were used in stand 14 of the mill 3 with a roughness of less than 0.04 μm Ra. This produced a reduction in 18% and a hardness exactly in the DR 580 range.

Trials 5, 6, 7 and 8 made use of a higher bridle capacity with three pairs instead of two pairs of bridle rolls as well as a different emulsion B of the same synthetic ester in water but with large drops (internal phase globules) of size greater than 1 μm.

In trial 6 the quantity of lubricant (synthetic ester) in the emulsion was raised from 2 to 3 percent weight; even with ground rolls this can achieve a reduction of 30% and DR 580.

In trial 7 polished work rolls were used as in trial 4 and this achieved a reduction of 35% and DR 620. Finally in trial 8 chrome-plated work rolls were used in stand 14, by which ultra thin packaging steel was manufactured with a thickness of 0.12 mm.

FIG. 1 shows an apparatus in which, after being decoiled in a decoiler 2, the already cold-reduced strip 1 runs from right to left through a continuous annealing furnace 7 and a rolling mill 3 for cold-reduction, and finally is coiled by a coiler 4.

Seen in the direction of travel of the strip, the continuous annealing furnace consists successively of a cleaning line 5, an entry looping tower 6, the continuous annealing furnace 7 itself and the exit looping tower 8. The strip 1 runs through furnace 7 at a constant speed. The strip 1 is not permitted to stop. To this end, on the entry side of furnace 7 there is the looping tower 6 in which a stock of strip is stored and which the furnace 7 takes off when the head of a new coil is welded onto the tail of the preceding coil at the decoiler 2. In like manner strip from the furnace 7 is stored in the looping tower 8 when the rolls of the rolling mill 3 are changed, during which changing the mill does not take off any strip. FIG. 1 shows schematically that the exit looping tower 8 is approximately twice the size of the entry looping tower 6. This ratio is suitable since the mill 3 has rolls driven on one side of the strip only, as explained above whereby changing of rolls can take place rapidly because rolls can be introduced into the mill from the one side of the mill while rolls are removed from the other side. If the rolls were driven on both sides of the strip, the exit looping tower 8 would have to be approximately three times the size which would mean a far greater cost investment for the exit looping tower.

In FIG. 2 the strip 1 runs from right to left successively through the bridle 9 on the entry side, the rolling mill 3 for cold rolling and the bridle 10 on the exit side 10. The bridles 9 and 10 impose an increased tensile stress in the strip between the bridles for the purpose of reducing the strip in thickness in the rolling mill, that is to say a tensile stress which is far higher than the tensile stress for just conveying the strip in the continuous annealing furnace. In FIG. 2 each of the bridles 9 and 10 consist of three bridle roll pairs 11, 12 and 13, while conventionally these bridles usually each consist of at most two bridle roll pairs. So in FIG. 2 the bridle capacity is increased by the addition of an extra bridle roll pair so that an additionally increased tensile stress is obtained in the strip. The bridle rolls each have relatively large diameter of 750 mm.

The rolling mill 3 in FIG. 2 is a so-called two stand, six-high rolling mill with a first roll stand 14 and a second roll stand 15. Each stand has work rolls 16, intermediate rolls 17, and back-up rolls 18. Before stand 14, between stand 14 and stand 15, and after stand 15 there are sets of stress recording tension rolls 19, each consisting of three rolls for measuring the tensile stress in the strip. Furthermore, at various positions in the temper-rolling mill, the figure shows sprays 20 for supplying rolling fluid. Between two deflector rolls 21 at the exit side there is a

TABLE 1

| | emulsion type | emulsion % wt. | strip exit | bridles | work roll roughness stand 14 μm Ra | work roll roughness stand 15 μm Ra | rolling force kN | tension in strip* kN | total reduction in stands 14 and 15% | final thickness mm | remarks, quality of product |
|---|---|---|---|---|---|---|---|---|---|---|---|
| 1 | none | none | n/a | 4 rolls | 0.80 | 0.40 | 4000 | 15 | up to 2% | 0.19 | up to T67 |
| 2 | A | 2 | wet | 4 rolls | 1.5 | 0.4 | 6000 | 30 | not defined | not defined | slip due to wet strip surface |
| 3 | A | 2 | dry | 4 rolls | 1.7 | 1.0 | 6000 | 30 | 15 | 0.16 | T65–T67 |
| 4 | A | 2 | dry | 4 rolls | <0.04 | 1.0 | 6000 | 30 | 18 | 0.16 | DR 580 |
| 5 | B | 2 | dry | 6 rolls | 0.40 | 0.60 | 5000 | 35 | 20 | 0.15 | DR 580 |
| 6 | B | 3 | dry | 6 rolls | 0.40 | 0.60 | 5000 | 40 | 30 | 0.13 | DR 580 |
| 7 | B | 3 | dry | 6 rolls | <0.04 | 0.60 | 6000 | 40 | 35 | 0.13 | DR 620 |
| 8 | B | 3 | dry | 6 rolls | <0.04 (chrome-plated) | 0.60 | 7000 | 40 | 40 | 0.12 | DR 620 |

*measured between roll stands 14 and 15 drying apparatus with means 23 for blowing hot air. Not shown in FIG. 2 are means such as for example splash guards placed in the rolling mill for ensuring that, on leaving the rolling mill, the strip takes with it as little rolling fluid as possible. A thickness gauge 20 is placed after the last set of stress recording tension rolls for measuring the thickness of the strip after rolling. The thickness measured here serves as criterion for corrections in the reduction. A thickness gauge 25 is placed before the rolling mill for measuring the thickness of the strip before rolling.

While the invention has been illustrated by embodiments and examples, it is not limited to them, and modifications and improvements can be made within the scope of the inventive concept.

What is claimed is:

1. Apparatus for manufacture of DR steel strip, having (i) a continuous annealing furnace adapted for annealing of cold-reduced steel strip passing continuously through said furnace, (ii) a cold rolling mill for cold-rolling of steel strip arranged to receive in-line the output of annealed steel strip from said furnace and having at least one roll stand having a pair of work rolls of which only one is driven externally, (iii) means for applying tension to said strip being rolled in said rolling mill, including first tension applying means downstream of said rolling mill and second tension-applying means upstream thereof, (iv) means for supplying rolling fluid to said strip being rolled in said rolling mill, and (v) means for removing said rolling fluid from said strip prior to entry of said strip to said first tension-applying means.

2. Apparatus according to claim 1 wherein said rolling mill has at least two said roll stands comprising an upstream roll stand and a downstream roll stand, each having a said pair of work rolls of which only one is driven externally.

3. Apparatus according to claim 2 wherein each said roll stand is a six-high roll stand.

4. Apparatus according to claim 2 wherein said upstream roll stand has a pair of work rolls whose surface roughness is less than 0.04 μm Ra.

5. Apparatus according to claim 2 wherein said upstream roll stand has a pair of work rolls which are at least one of polished and chrome-plated.

6. Apparatus according to claim 1 wherein said first tension applying means comprises a plurality of bridle roll pairs.

7. Apparatus according to claim 6 wherein said second tension applying means comprises a plurality of bridle roll pairs.

8. Apparatus according to claim 7 wherein each of said first and second tension applying means has three bridle roll pairs.

9. Apparatus according to claim 7 wherein each of said first and second tension applying means has at least one bridle roll pair with a roll diameter of at least 750 mm.

10. Apparatus according to claim 1 wherein said means for removing said rolling fluid comprises drying means.

11. Apparatus according to claim 1 having a thickness gauge for measuring the thickness of the steel strip after exit from said rolling mill.

12. Apparatus according to claim 1 having a thickness gauge for measuring the thickness of the steel strip before entry to said rolling mill.

* * * * *